US009565884B2

(12) United States Patent
Grame et al.

(10) Patent No.: US 9,565,884 B2
(45) Date of Patent: Feb. 14, 2017

(54) SUNGLASS AND ARTICLE HOLDER

(71) Applicant: BLOB PRODUCTS, LLC, Los Altos, CA (US)

(72) Inventors: Karl A. Grame, Los Altos, CA (US); Arthur L. Cohen, Cupertino, CA (US); Robert L. Fullerton, Morgan Hill, CA (US)

(73) Assignee: BLOB PRODUCTS, LLC, Los Altos, CA (US)

( * ) Notice: Subject to any disclaimer, the term of this patent is extended or adjusted under 35 U.S.C. 154(b) by 123 days.

(21) Appl. No.: 14/315,196

(22) Filed: Jun. 25, 2014

(65) Prior Publication Data

US 2015/0013114 A1 Jan. 15, 2015

Related U.S. Application Data

(60) Provisional application No. 61/844,117, filed on Jul. 9, 2013.

(51) Int. Cl.
*A42B 1/24* (2006.01)
*A45F 5/02* (2006.01)

(52) U.S. Cl.
CPC ..... *A42B 1/247* (2013.01); *A45F 5/02* (2013.01); *A45F 2200/0541* (2013.01); *Y10T 24/1385* (2015.01)

(58) Field of Classification Search
CPC .... A42B 1/247; A45F 5/02; A45F 2200/0541; Y10T 24/1385; Y10T 24/3459; Y10T 24/492;Y10T 24/493; Y10T 24/497; Y10T 24/495
See application file for complete search history.

(56) References Cited

U.S. PATENT DOCUMENTS

| | | | | |
|---|---|---|---|---|
| 2,619,640 | A * | 12/1952 | Weissberg | A42B 1/247 2/10 |
| 7,496,991 | B2 | 3/2009 | Avery | |
| D643,212 | S | 8/2011 | Rathbun | |
| 8,235,262 | B1 | 8/2012 | Sakdol | |
| 8,615,853 | B2 | 12/2013 | Rathbun | |
| 8,696,112 | B1 | 4/2014 | Vaught | |
| 2012/0272483 | A1* | 11/2012 | Moore | A42B 1/247 24/3.3 |
| 2014/0223636 | A1* | 8/2014 | Leon | A42B 1/247 2/181 |

FOREIGN PATENT DOCUMENTS

| | | | | |
|---|---|---|---|---|
| KR | 20120081310 A | * | 7/2012 | A42B 1/247 |
| NO | GB 191501945 A | * | 8/1915 | A44B 1/34 |

* cited by examiner

*Primary Examiner* — Robert J Sandy
*Assistant Examiner* — Matthew Sullivan
(74) *Attorney, Agent, or Firm* — Craig M. Stainbrook; Stainbrook & Stainbrook, LLP

(57) ABSTRACT

Apparatus for holding an article against a fabric panel, for instance on an article of clothing, including a base having a top side and a generally planar bottom side, a plurality of fabric penetrating elements extending from the bottom side, and a resilient retaining loop disposed on the top side, the resilient loop having an article engaging through slot configured to accept and releasably capture an elongate element of an article inserted through the through slot.

19 Claims, 12 Drawing Sheets

FIG. 10
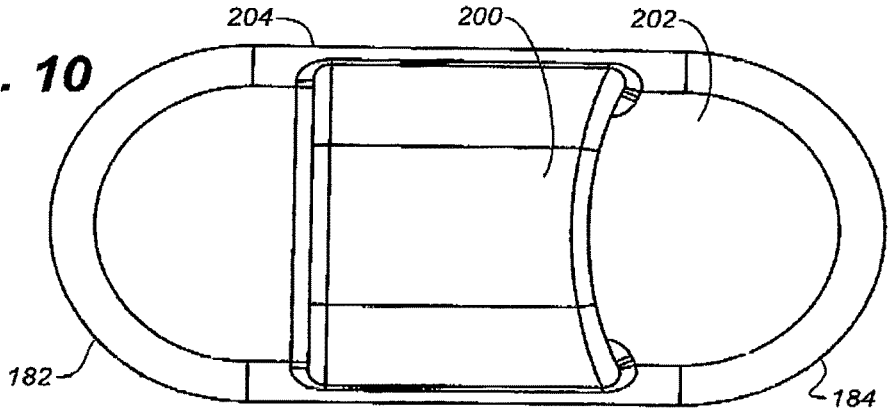
FIG. 11
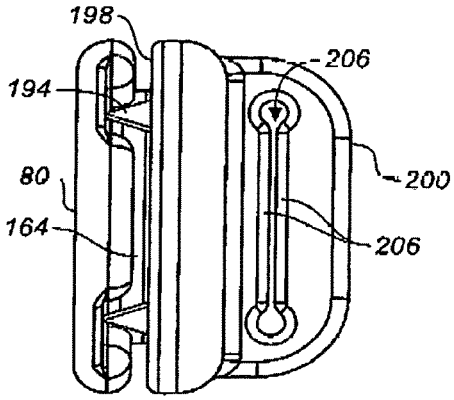
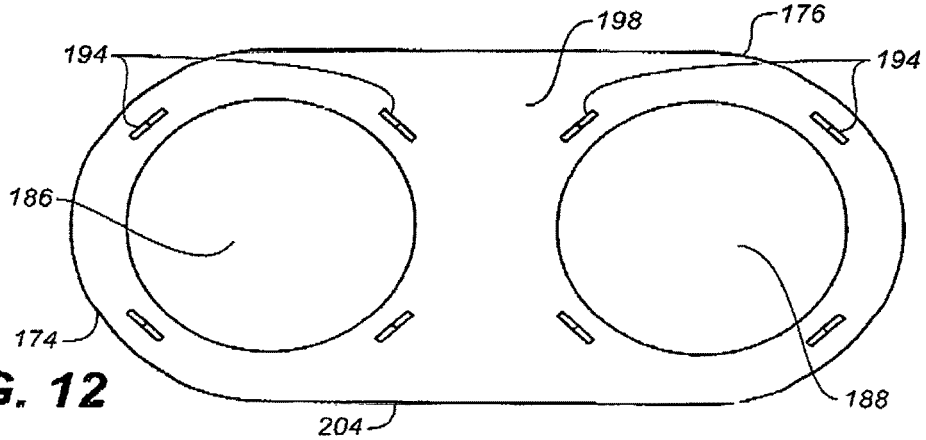
FIG. 12

100
Cp
150
206
200
194
Sb
13D
164

100
Cp
206
200
194
164
80
Sb 100
90
Cp
80
164
206
200
172
198
194
186
Sb

SUNGLASS AND ARTICLE HOLDER

CROSS REFERENCES TO RELATED APPLICATIONS

The present application claims the benefit of the filing date of U.S. Provisional Patent Application Ser. No. 61/844,117, filed Jul. 9, 2013 (Jul. 9, 2013), and which is incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

SEQUENCE LISTING

Not applicable.

BACKGROUND OF THE INVENTION

Field of the Invention

The present invention relates most generally to apparatus for holding small items, such as eyeglasses or sunglasses, on fabric articles, and more particularly to an article holder for securing onto a cap or hat an article having an elongate element, such as the ear piece of eyeglasses or sunglasses having ear piece.

Background Discussion

Those involved in active outdoor lifestyles frequently wear protective headwear, such as a cap or hat, and equally frequently also wear protective eyewear, whether eyeglasses or sunglasses. Users routinely remove the glasses for any of a number of reasons, e.g., because the corrective prescription is temporarily unnecessary, because light conditions change and eliminate the need for filtering, or simply because they may be engaged in a conversation in which eye contact is appropriate. Accordingly, users need an expedient and convenient way to remove the glasses temporarily yet to keep them at the ready when their use is called for once again.

A commonly used solution is to use a strap secured to the eartip portion of the ear pieces so that removal of the glasses leaves the glasses dangling from the user's neck, in the manner of donning a necklace. If a cap or hat is worn, it is common for users simply to remove the glasses and secure them above the hat brim and crown and around the side panels of the cap slightly above the sweat band and over the user's ears.

While glasses straps are indeed quite convenient, some users find them uncomfortable. The strap bounces about on the back of the user's neck when the glasses are worn, and the glasses dangle rather heavily in front of and under the user's chin when removed.

On the other hand, simply removing glasses and placing them onto a cap or hat risks losing the glasses.

It would be desirable to have a small, inexpensive, easily installable and removable apparatus to secure articles, especially glasses, to a cap or hat. To that end, several article holders have been proposed, several involving magnets as the clamping mechanism. None, however, have provided a means for securing the article holder to a cap or hat or other fabric panel in such a way as to prevent inadvertent detachment of the article holder by lateral movement of one or more of the clamping elements.

BRIEF SUMMARY OF THE INVENTION

It is therefore an object of the present invention to provide a new and improved article holder for securing a small article to a fabric panel, such as that found on a cap, blouse, jacket, or trousers. The inventive article holder includes a base having a top side and a bottom side; a plurality of fabric penetrating points disposed around its perimeter and extending downwardly from said bottom side of said base, and a resilient retaining loop disposed on the top side of the base. The resilient retaining loop has an article insertion slot and a through hole, such that securing the article holder to a fabric panel is accomplished by placing the bottom side of the base to the fabric panel so as to penetrate the fabric panel with the points so as to clasp the base onto the fabric panel. Such an affixation prevents at least lateral movement of the base in relation to the fabric panel.

It will be appreciated that the slot in the resilient retaining loop is sized to permit insertion of an elongate element of an article and to releasably capture and hold the elongate element until manually removed by a user.

The article holder of the present invention is particularly well-suited for use in pairs, to be installed on the panel sides of a cap above a user's ears for holding a pair of eyeglasses or sunglasses.

However, the article holder of the present invention is equally suitable for holding any of a number of small articles having an elongate element or feature capable of insertion in and through the through hole of the resilient loop.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto. The disclosure is not limited in its application to the details of the construction and the arrangements set forth in the following description or illustrated in the drawings. The inventive apparatus is capable of other embodiments and of being practiced and carried out in various ways. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure.

For a better understanding of the present invention, its advantages and the specific objects attained by its uses, reference should be made to the accompanying drawings and descriptive matter in which there are illustrated the preferred embodiment.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein:

FIG. 10 is a top plan view thereof;

FIG. 11 is a left side view in elevation thereof;

FIG. 12 is a bottom plan view thereof;

DETAILED DESCRIPTION OF THE INVENTION

Figure 1:
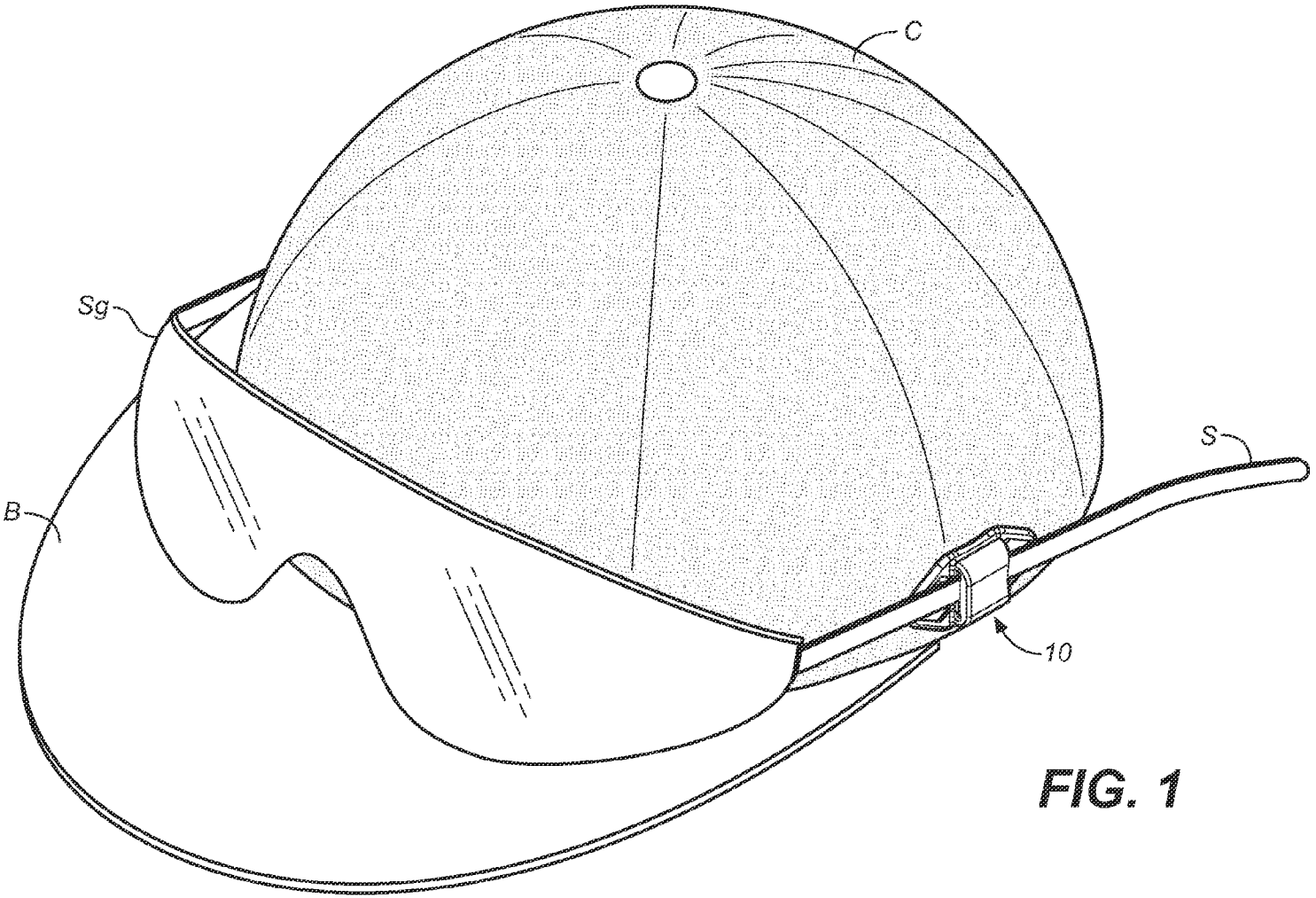
FIG. 1 is an upper front perspective view showing the article holder of the present invention installed on a sports cap and with the stem of a sunglasses disposed through the retaining loop.
Figure 2A:
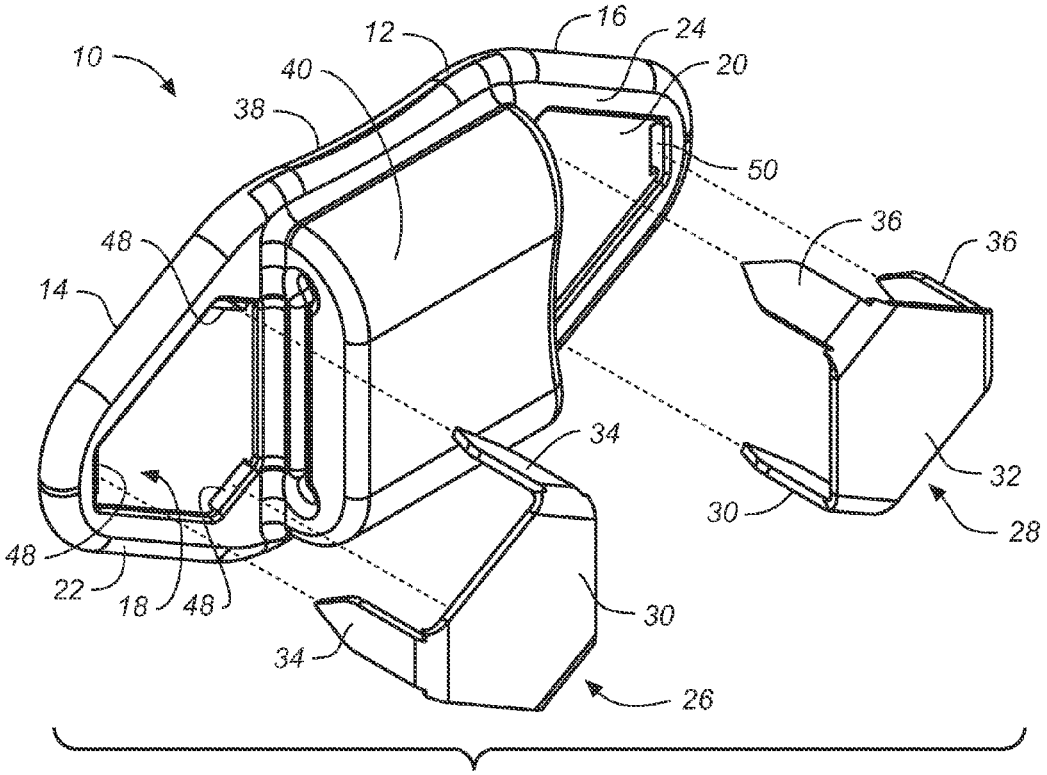
FIG. 2A is an exploded upper front left perspective view of the article holder of the present invention, showing the clasping staples poised for installation.
Figure 2B:
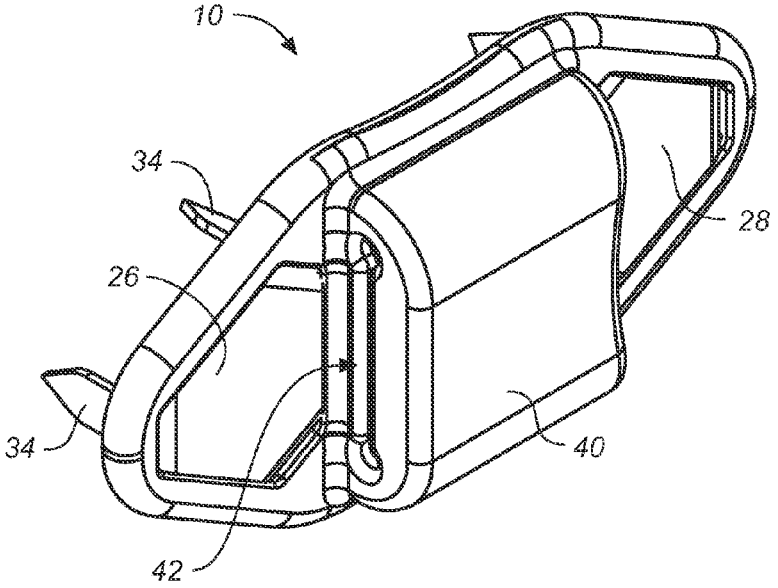
FIG. 2B is an upper front left perspective view thereof showing the clasping staples installed on the holder base and the points disposed through the staple point holes.
Figure 3:
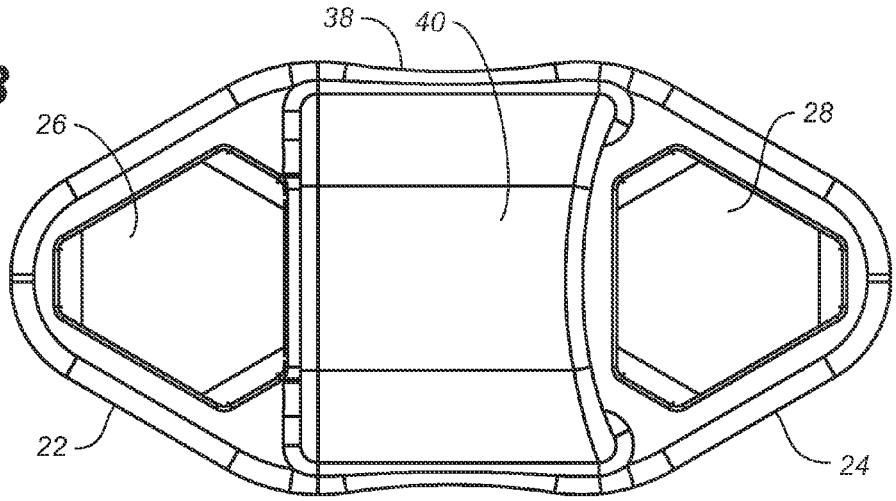
FIG. 3 is a top plan view thereof.
Figure 4:
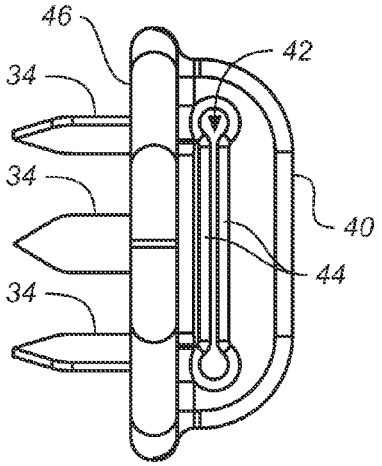
FIG. 4 is a left side view in elevation thereof.
Figure 5:
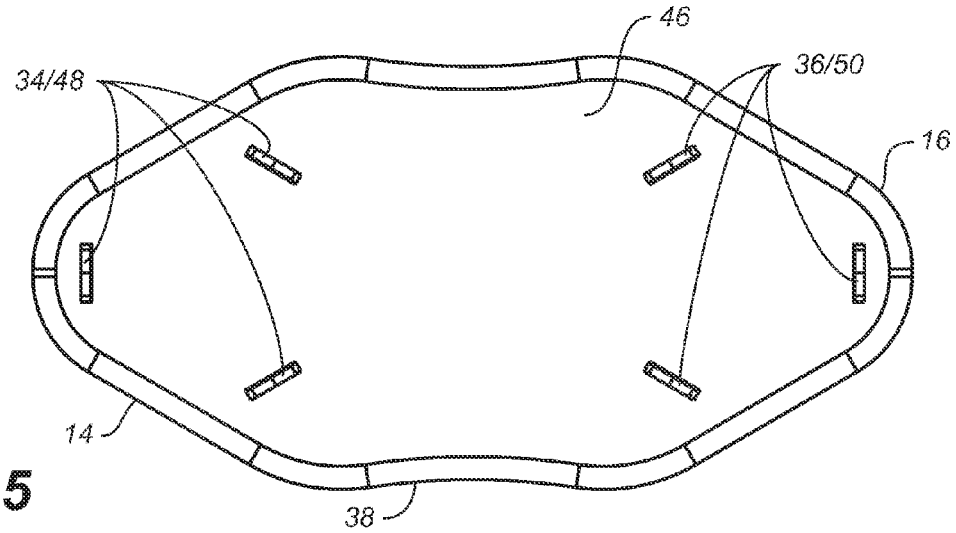
FIG. 5 is a bottom plan view thereof.

Referring first to FIGS. 1 through 7B, wherein like reference numerals refer to like components in the various views, there is illustrated a first preferred embodiment of a new and improved article holder, generally denominated 10 herein. The inventive apparatus includes a resilient base 12, preferably fabricated from silicone, synthetic rubber, or plastic. The base has a first end 14, a second end 16, each of said first and second end having a depression, pocket, or recess 18, 20, respectively, surrounded by a curb or knurl 22, 24, respectively. The recesses accept and the curbs surround staples 26, 28, which are employed as clasping devices to secure the article holder to a fabric panel, such as a baseball cap panel Cp. The staples are configured with a generally planar base plate 30, 32 which conforms to the shape of the recess, such that the base plate of the staple is either substantially flush with the top of the curb or, more preferably, slightly set in, when the staples are installed (as discussed below), so as to secure the staple and prevent lateral movement about the base. The staples each include a plurality of fabric penetrating elements, such as points or tines 34, 36, for insertion through conforming holes 48, 50 in the base. The points are preferably bendable and are also preferably disposed in corners of the recesses.

The article holder further includes a medial portion 38 disposed between the first and second ends, and a resilient retaining loop 40 disposed thereon. The loop may be integral with or otherwise coupled to the base, its essential feature being that it forms a retaining through passage 42 suitable for receiving an elongate element of an article to be held. For instance, the through passage is configured to accept the stem S of a pair of sunglasses Sg. Precisely this function is featured in FIGS. 1 and 7A-7B. At either or both openings of the through passage 42, a pair of opposing resilient flaps or ribs 44 may be provided, so as to form a slot 45 that enhances the holding capacity of the resilient loop. In a preferred embodiment, the resilient ribs are disposed only proximate the side of the resilient retaining loop that will be the side from which the elongate element is extended, rather than the side into which the elongate element is inserted. Thus, the elongate element is captured at the distal opening considered in relation to how the elongate element is inserted into the resilient retaining loop. It will be appreciated, however, that the resilient ribs may be located in any of a number of suitable locations within the interior space formed by the loop, the essential function being accomplished by having ribs that act like flaps or lips to accommodate and then capture the elongate element.

It will be appreciated that the outer surface (signified by reference number 40 in FIG. 2B) of the resilient retaining loop can be used as commercial branding space for bearing company logos and names or other word and graphic elements.

Figure 6C:
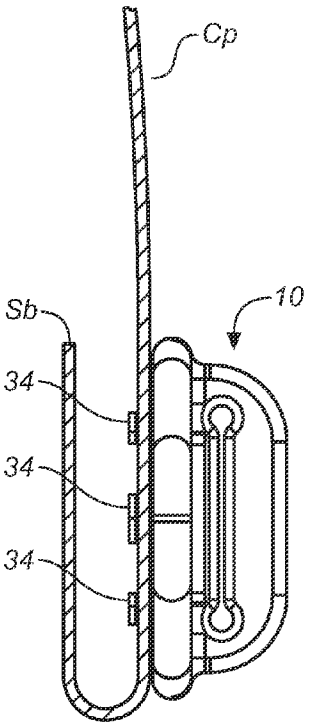
FIG. 6C is the same view showing the staple points bent to secure the article holder in place on the cap.
Figure 6B:
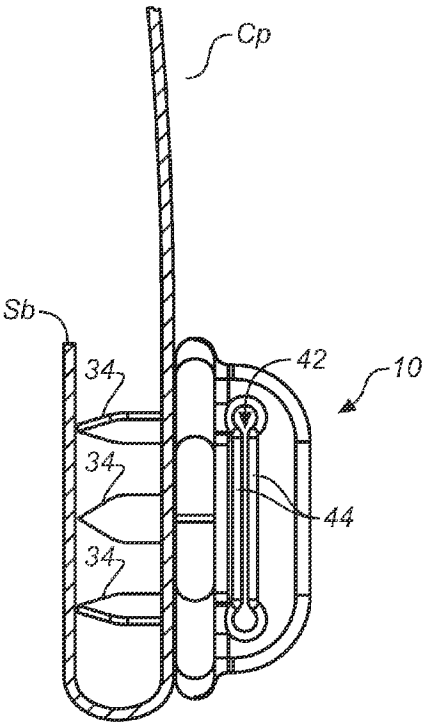
FIG. 6B is a partial cross-sectional left side view in elevation thereof showing the article holder applied to the side of the cap and the clasping staples installed on the base with the staple points penetrating the cap fabric.
Figure 6A:
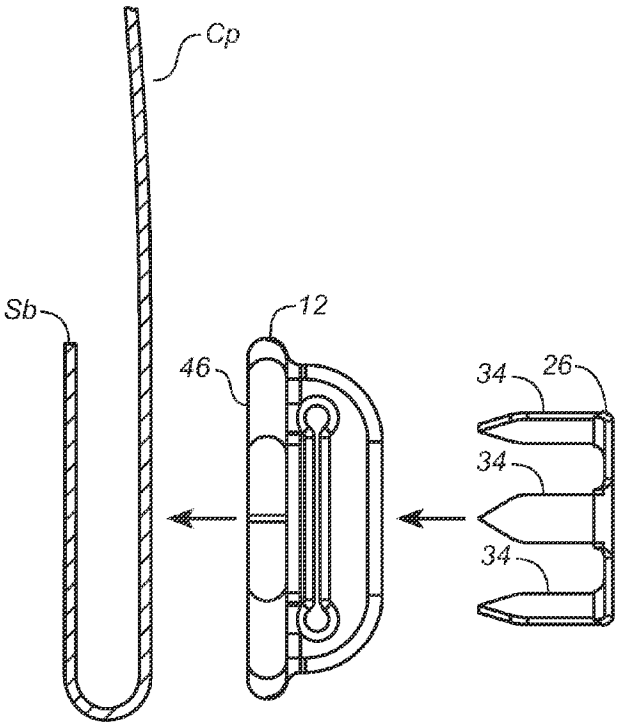
FIG. 6A is a partial cross-sectional left side view in elevation showing the inventive article holder positioned for installation on the sweatband portion of a baseball cap panel, which is shown in cross-section as seen along section line 6C-6C of FIG. 7A.
Figure 7A:
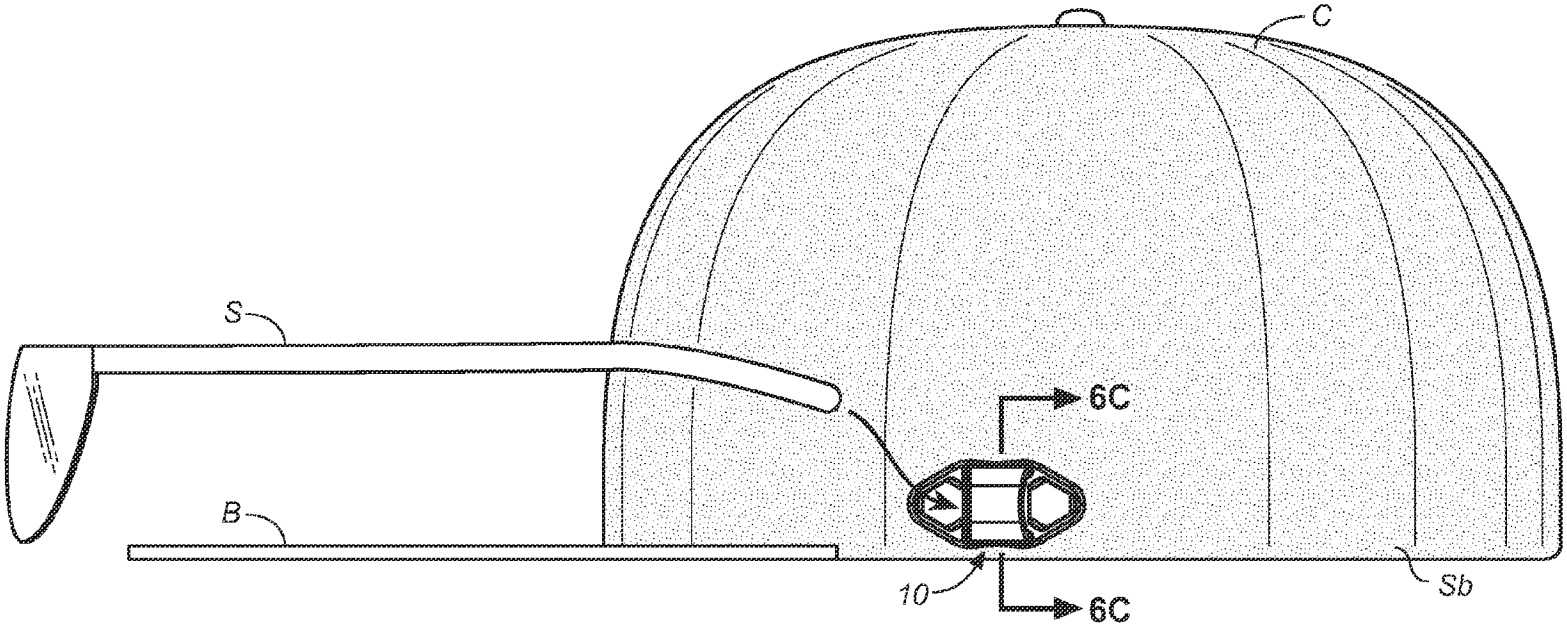
FIG. 7A is a top plan view of the article holder and side view in elevation of a cap showing the article holder installed on the sweatband portion of the cap panel and the stem of a pair of sunglasses positioned for insertion through the through-passage of the retaining band.
Figure 7B:
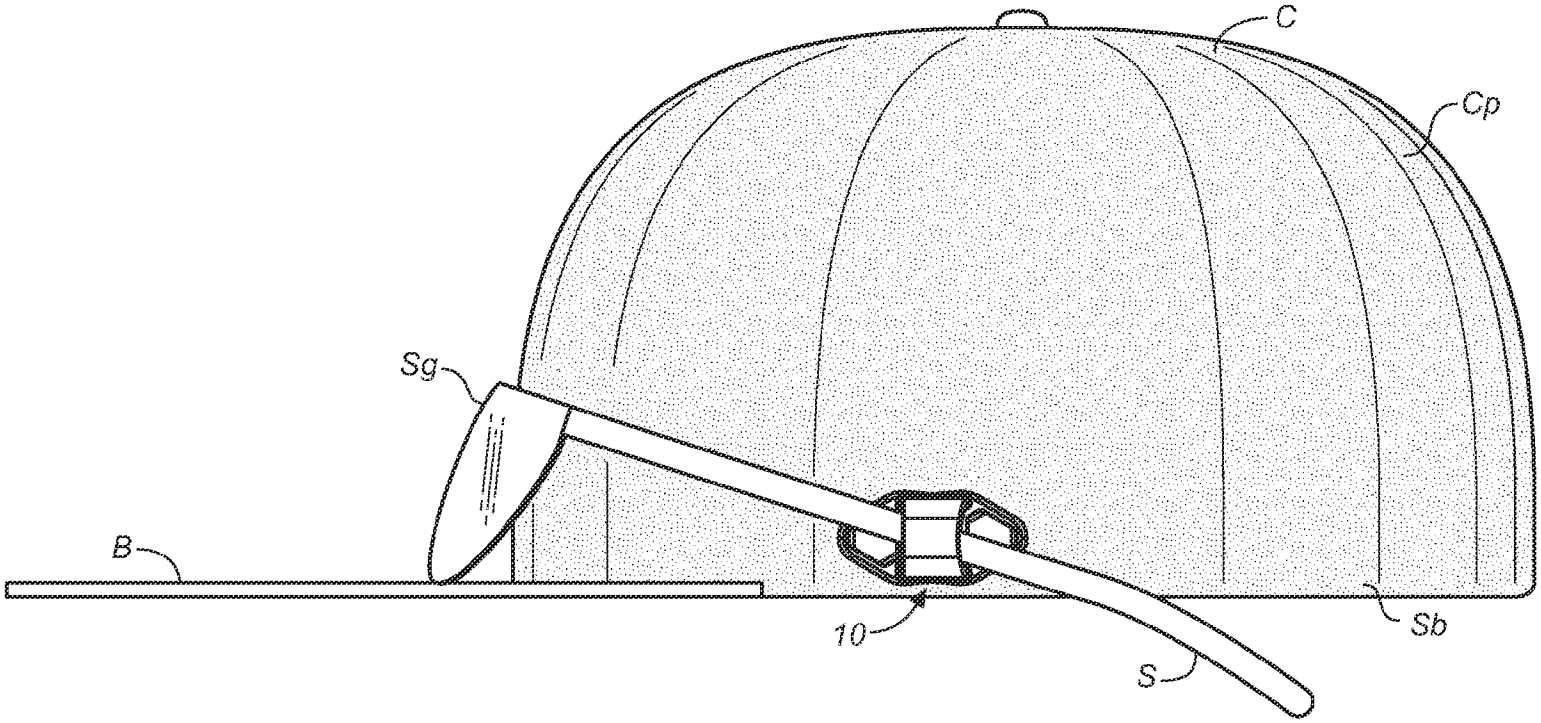
FIG. 7B is the same view showing the stem inserted fully through the through-passage and the sunglasses held in place on the bill of the cap immediately in front of the cap crown.

Referring especially to FIGS. 6A-6C, it will be seen that installation of the article holder on a cap is accomplished by placing the cap-engaging side 46 of the base 12 on the sweat band portion Sb of the cap panel Cp (FIG. 6A). Thereafter, the staples are pushed into place so that the points 34 (first staple only) pass through the point holes 48 and penetrate the cap panel Cp (FIG. 6B). The points or tines 34 are then bent over and the article holder is thus secured in place on the cap panel (FIG. 6C). In this position, it is adapted for accepting and retaining the stem of a pair of sunglasses. Accordingly, the holder is generally installed on one side of the cap on the cap panel proximate the wearer's ear, and a complementary article holder is installed on the other side of the cap so that a pair or set are provided to hold the sunglasses.

However, it will also be appreciated that the article holder is suitable for installation on any of a number of kinds of fabric panels and for holding any of a number of articles with elements capable of insertion in the through slot. Accordingly, there is nothing limiting implied in the use of sunglasses as a possible article to be held by the inventive article holder.

Figure 8B:
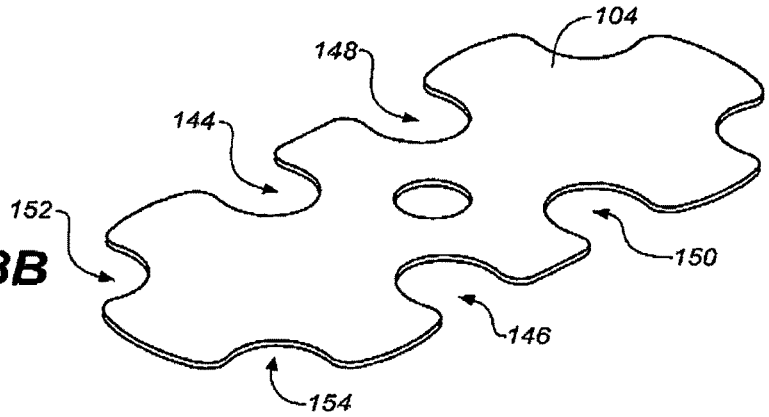
FIG. 8B is an upper perspective view of the rigid insert plate removed from the rubber frame and magnets.
Figure 8A:
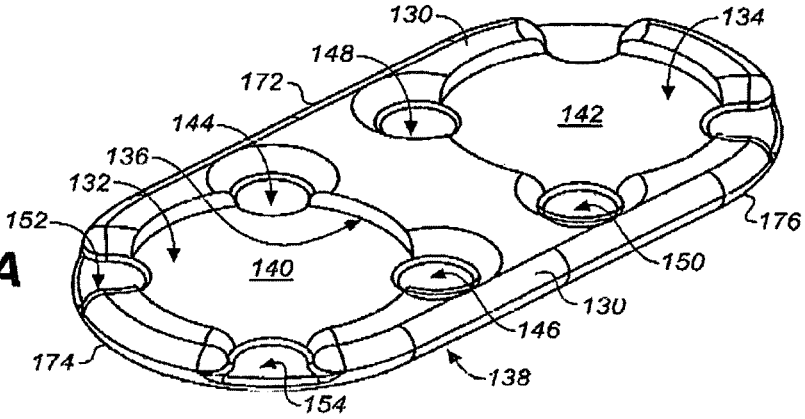
FIG. 8A is the same view showing the insert plate embedded in a the molded rubber frame with the magnets removed.
Figure 8:
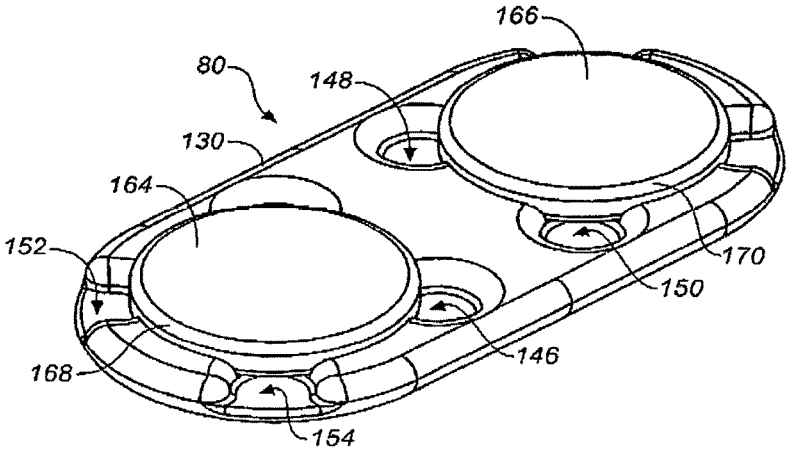
FIG. 8 is an upper perspective view showing an inner magnetic clasp member comprising two disc magnets affixed to a rigid insert plate captured in a molded rubber frame as used for a second preferred embodiment of the article holder of the present invention.
Figure 9A:
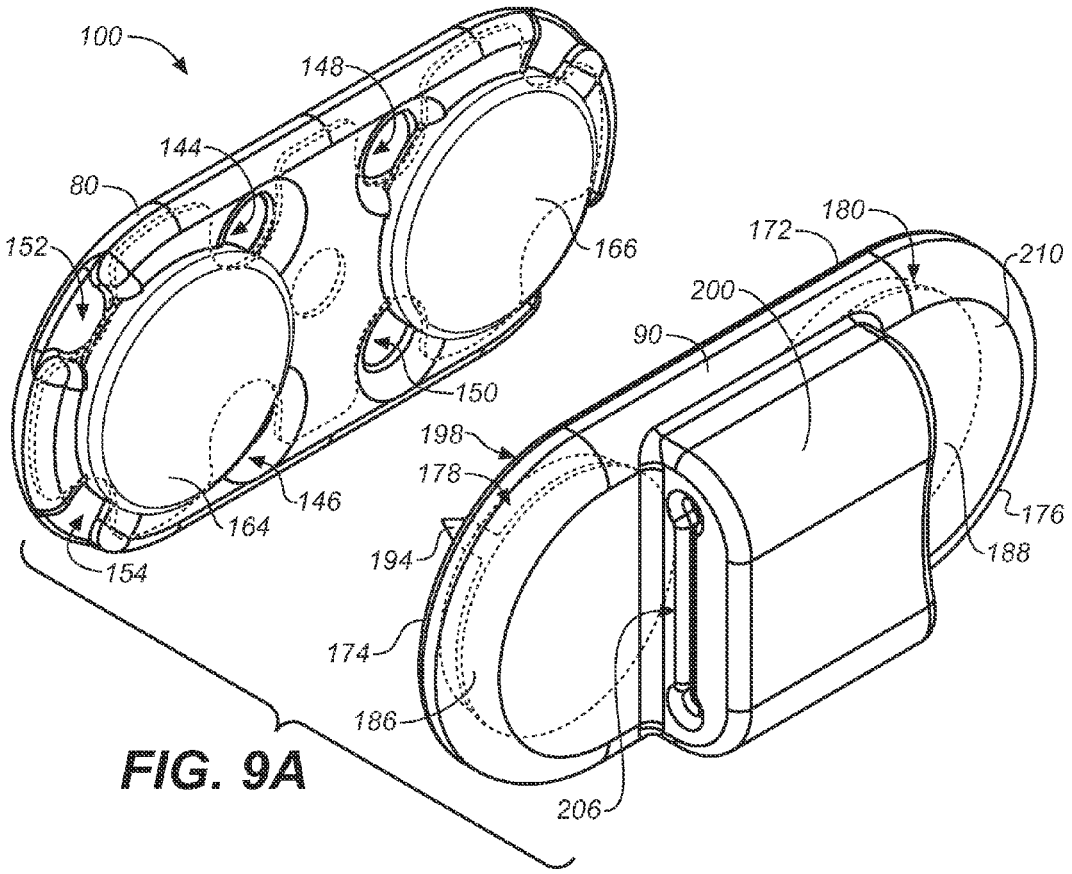
FIG. 9A is an exploded upper front left perspective view showing an outer clasp member poised for magnetic coupling with an inner clasp member.
Figure 9B:
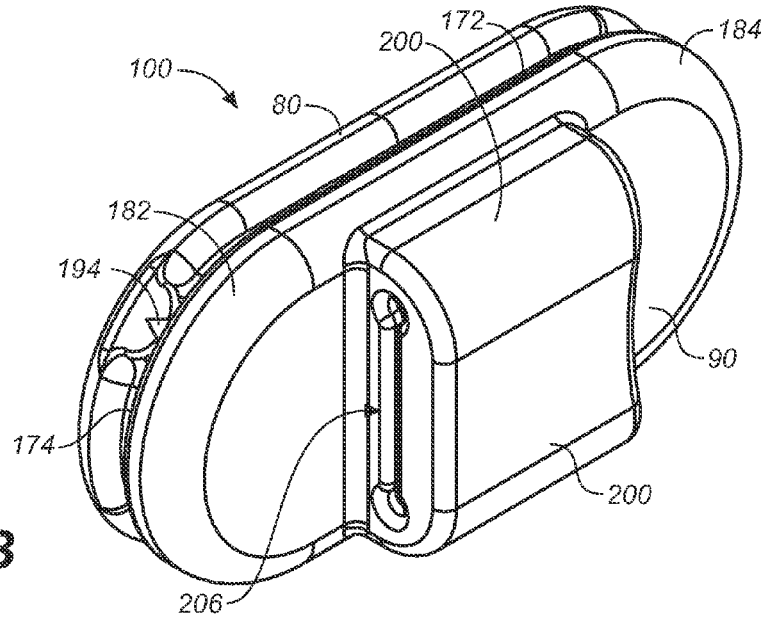
FIG. 9B is an upper front left perspective view showing the clasp members magnetically coupled.
Figures 13A, 13B, 13C:
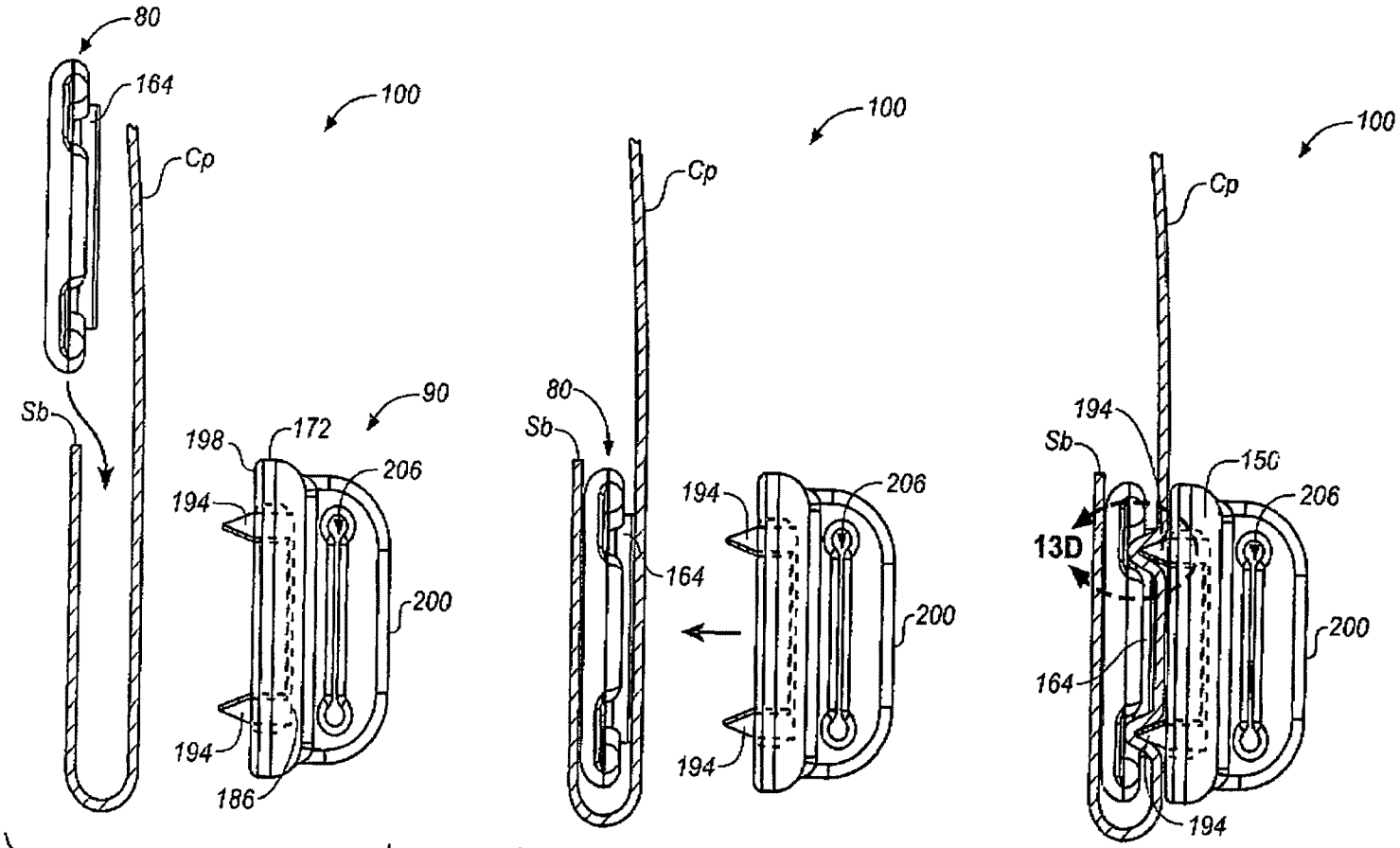
FIG. 13A is a left side view in elevation showing the inner and outer clasp members prepared for installation on a fabric cap.
FIG. 13B is the same view showing the inner clasp member disposed in the inner band fold of a cap and the outer clasp member prepared for placement on the exterior.
FIG. 13C shows the outer clasp member placed on the outside fabric panel and cooperatively engaging with the inner clasp member so as to retain the article holder on the fabric panel.
Figure 13D:
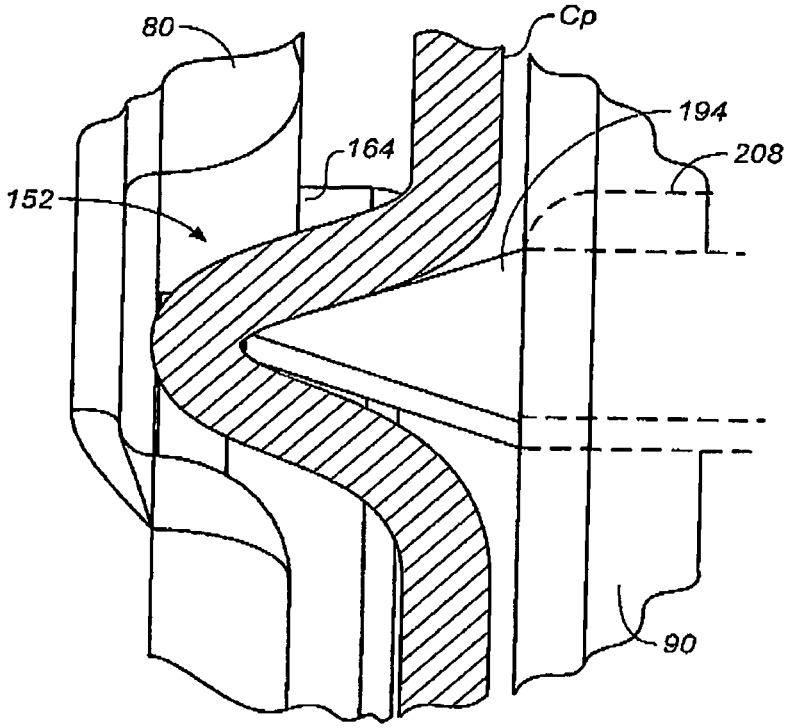
FIG. 13D is a detailed cross-sectional side view in elevation showing how the out clasp member points of the second preferred embodiment may be employed to deform fabric to engage the recesses in the inner clasp member.

Referring next to FIGS. 8-13C, there is shown a second preferred embodiment 100 of the article holder of the present invention. FIGS. 8-8B feature the inner clasp member 80 and its component parts, which first includes a rigid insert 104, for structural rigidity. The insert is an oval plate patterned with plurality of cutouts, a pair 106, 108, and 110, 112 on each long side 114, 116, and two 118, 120 and 122, 124 on each end 126, 128. The insert is preferably fabricated from a rigid plastic or from annealed austenitic grade 300 series stainless steel with low magnetic permeability, thus demonstrating essentially no response to a magnet while also providing good corrosion resistance. Cutouts are preferably arcuate in shape, though any of a number of suitable shapes are serviceable.

The inner clasp member next includes a rubber frame 130 molded around the rigid insert so as to leave to generally circular portions 132, 134 of the rigid insert exposed and such that the surface 136 of the interior side 138 of the rubber frame is substantially coplanar with the surfaces 140, 142 of the rigid insert 104. Circular medial depressions or recesses 144, 146, 148, 150, are formed and located at the medial cutouts 106, 108, 110, 112 of the rigid insert; and semicircular recesses 152, 154, 156, 158 are formed at the ends of the frame 160, 162, located at corresponding cutouts 118, 120, 122, 124. Two magnets 164, 166 are affixed (preferably with adhesives) to the exposed surfaces 140, 142 of the rigid insert. The magnets have a circumferential edge 168, 170 that preferably overlaps at least a portion of all of the recesses, though an edge-to-edge relationship is also possible—i.e., the edge of the magnets disposed immediately above the edge of the recesses.

The second preferred embodiment next includes an outer clasp member 90 having a resilient base 172, preferably fabricated from silicone, synthetic rubber, or plastic. The base has a first end 174, and second end 176, each of said first and second end formed to include an interior space 178, 180, respectively, bordered by a side wall 182, 184, respectively. The interior spaces contain, in the first instance, staple plates 186, 188, which are employed either to penetrate a fabric or to deform (bend) the fabric so as to surround and secure the magnets of the inner clasp member of the article holder with either the points themselves or with the points pressing the fabric into the circular recesses 144, 146, 148, 150, and the semicircular wells or recesses 152, 154, 156, 158. Whether the points penetrate the fabric depends on the tightness of the fabric weave, the fabric fibers, and the size and sharpness of the points. The staples are configured with a generally planar base plate 190, 192 which generally conforms to the shape of the interior space, such that the base plates of the staples are firmly circumferentially engaged by the side walls. The staples include a plurality of points or tines 194, 196 which extend from the bottom 198 of the resilient base. A resilient loop 200 is disposed on the top side 202 of the medial portion 204 of the resilient base between the staple plates. The loop is preferably integral with the top of the base, again having a carefully dimensioned and formed through passage 206 suitable for receiving an elongate element of an article to be held. The slot is configured to accept the stem S of a typical pair of eyeglasses or sunglasses, as featured in earlier discussed FIGS. 1 and 7A-7B. The through-passage extends entirely through the resilient loop and may either have contiguous sides or can be provided with structure, for instance opposing resilient ribs 208, at either or both openings of the passage, thereby forming a slot 210.

As noted, dimensioning of the slot is carefully tailored to the retention of eyeglasses and sunglasses. In that vein, slot dimensions (height, depth, width), rib size and resilience, and the Shore hardness of these features, were adjusted over considerable testing so as to provide for easy insertion of earpieces of a size found in the vast majority of sunglasses and eyeglasses designs.

The outer clasp member further includes first and second axially magnetized disc magnets 212, 214, preferably rare earth magnets, and still more preferably neodymium magnets. These are each disposed between a bottom side of a respective staple plate and the bottom 198 of the resilient base and are surrounded by tines 194, 196.

Referring especially to FIGS. 13A-13D, it will be seen that installation of the article holder on a cap is accomplished by placing the inner clasp member 80 in the space between the sweat band Sb and the cap panel Cp with the magnets 164, 166 facing the cap panel. The outer clasp member 90 is then pushed onto the cap panel so that the tines 194, 196 penetrate and pass through the fabric and into the recesses disposed on the inner clasp member. The points or tines 194, 196 remain unbent and instead engage the sides of the inner clasp member magnets so as to prevent the entire inner clasp member from moving laterally relative to the outer clasp member. In the alternative, the points may be configured not to pass through the fabric but only to deform the fabric so as to depress it into the recesses and thus to interfere with any lateral movement of the clasp members in relation to one another.

As is well known, the easiest way to uncouple two low profile (thin) magnets from one another is to slide them laterally across their surfaces. Thus, the present invention provides a distinct advantage over all known magnetic article holders using magnets for retention means and which may include cooperating interior and exterior plate or disc magnets, but which do not include means for capturing and retaining the inner magnets so that they do not slide laterally in relation to the exterior magnets, possibly breaking the coupling. In this way, the present invention provides a user of a secure attachment to the fabric article, and thus of the article retained in and by the article holder.

Furthermore, the points or tines that prevent lateral magnet movement also prevent the entire article from translating laterally along the surfaces of the fabric. Magnetic article holders using only planar magnets on each side of the fabric can slide or move laterally in relation to the fabric even if the magnets do not move in relation to one another. It is, quite literally, as if the fabric were slipping between the magnets. This problem is also resolved by the penetrating points or tines, thus providing them with important dual roles.

Figure 14B:
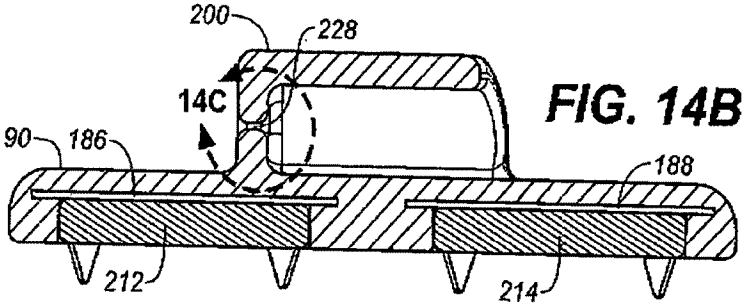
FIG. 14B is a lower side view in elevation of the outer clasp member.
Figure 14C:
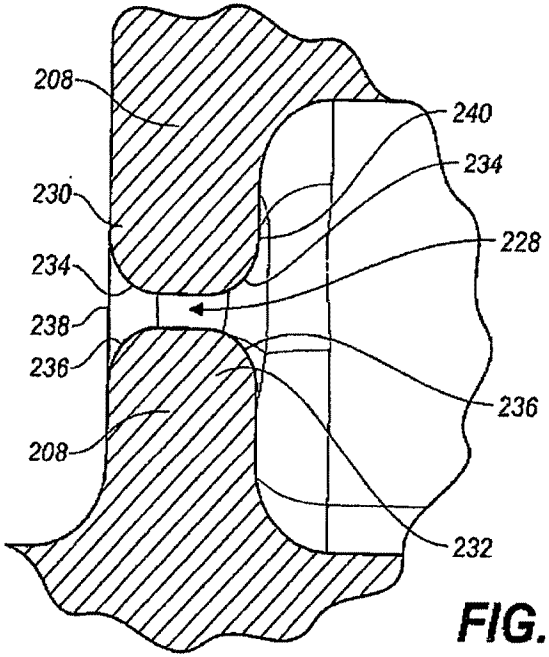
FIG. 14C is a detailed cross-sectional side view in elevation take along section line 14C of FIG. 14B.
Figure 14A:
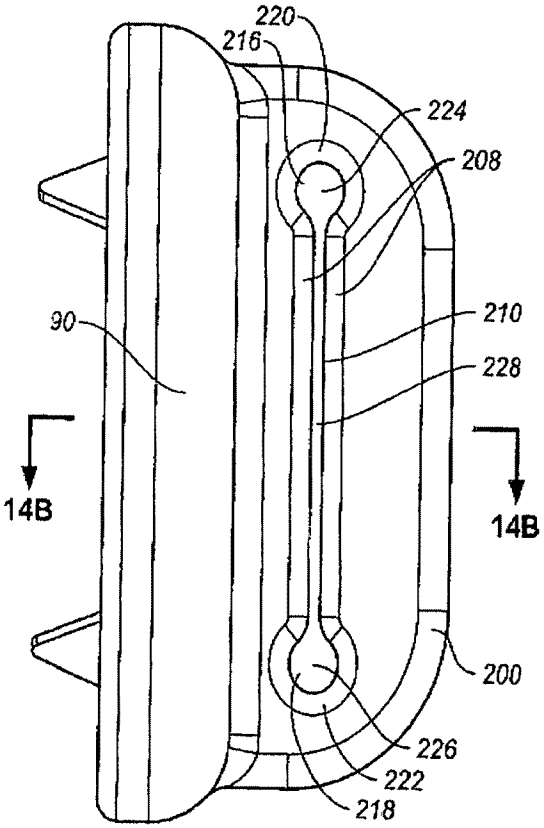
FIG. 14A is a left end view in elevation showing dimensional details of the frame capturing slot of the resilient loop in the present invention.

FIGS. 14A-14C show details of the article holding slot in the resilient loop disposed on the outer clasp member. The slot is configured such when the article holder is oriented as in FIGS. 13A-13B, the ribs 208 forming the slot 210 which opens to the through passage 206 is vertically disposed and includes an expansion 216, 218, on each of its upper and lower ends 220, 222. Each expansion comprises an approximately 1.25 mm circular opening that prevents or reduces tearing of the materials at the ends of the slot and permits the slot to open wider for thicker eyeglass frames. The slot itself 210 measures approximately 10.50 mm in length as measured from the geometric center 224, 226, of each of the expansions. This length dimension was empirically determined after measuring a large population and representative sample of sunglasses frames. The length of 10.5 mm was identified as the dimension long enough to facilitate insertion of the thickets frame samples measured.

The optimal separation or spacing 228 of the spaced apart ribs 208 forming the slot 210 has been identified as 0.30 mm when the resilient loop and the ribs are fabricated from 55-60 Shore A hardness material. At this width, the ribs and the through passage in the resilient loop cooperate to grip thinner wire frame glasses while still providing a slight opening for the insertion of thicker ear piece elements on glasses frames.

Finally, the inboard ends 230, 232 of the ribs 208 have corner curvature 234, 236 with a radius of 0.50 mm at both the interior and outer edges 238, 240 of the slot 210: This provides a "lead-in" or element guide for the sunglass ear piece portion of the frames when passing through the slot, making it easier to insert and withdraw the frames.

As will be appreciated by an inspection of the figures, the end portions of the article holder are generally triangular or semicircular in shape, and this gives the holder a kind of elegant, streamlined look. However, there is nothing essential about the shape of the end portions or the corresponding configuration of the recesses disposed therein.

The overall configuration or shape of the second preferred embodiment of the article holder is seen in the drawings to be somewhat elongate. As with the generally triangular end portions in the first preferred embodiment, the overall configuration is a design choice and is not limiting. In fact, in a preferred embodiment, the article holder of the present invention includes a generally circular button-type inner and outer clasp member with a single disc magnet disposed in each. As with the second preferred embodiment, the circular outer clasp member includes a single staple plate disposed over and around a single disc magnet, and the circular inner clasp member includes a single magnet with a frame configured as in the second preferred embodiment, with recesses surrounding the captured magnet. Accordingly, the staple points in the outer clasp member depress fabric into the recesses or penetrate the fabric and extend into the recesses, thereby prevent lateral movement of the magnets and clasp members in relation to one another.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An article holder, comprising:

an outer clasp member having a top side and a bottom side and at least one outer magnet disposed on said bottom side;

a plurality of fabric gripping points disposed around a perimeter of said outer clasp member and extending downwardly from said bottom side of said outer clasp member;

an inner clasp member having at least one inner magnet disposed on an inner side; and a resilient retaining loop disposed on said top side of said outer clasp member, said resilient retaining loop having an article insertion slot;

wherein affixation of said article holder to a fabric panel is accomplished by approximating said inner side of said inner clasp member to the fabric panel and said bottom side of said outer clasp member to the fabric panel opposite said inner clasp member so as to bring said outer magnet into magnetic engagement with said inner magnet and to grip the fabric panel with said fabric gripping points so as to clasp a portion of said fabric panel around an edge of said at least one magnet, thereby preventing at least lateral movement of said outer clasp member in relation to said fabric panel;

and wherein said slot in said resilient retaining loop is sized to permit insertion of an elongate element of an article and to releasably capture and hold the elongate element until manually removed by a user.

2. The article holder of claim 1, further including at least one staple having a base plate, and wherein said points arc disposed around the edges of said base plate.

3. The article holder of claim 2, wherein said outer clasp member includes at least one recess in said top side into which said base plate of said at least one staple is placed, and further including holes in said base through which said staple points pass.

4. The article holder of claim 3, wherein said recess is bordered by a curb.

5. The article holder of claim 4, wherein said base plate of said at least one staple is planar.

6. The article holder of claim 5, wherein said base plate conforms to the shape of the recess.

7. The article holder of claim 1, wherein said outer clasp member includes first and second ends and a medial portion disposed between said first and second ends, wherein said resilient retaining loop is disposed on said medial portion.

8. The article holder of claim 7, wherein said resilient retaining loop is integral with said outer clasp member.

9. The article holder of claim 7, wherein said resilient retaining loop forms a retaining through slot suitable for receiving an elongate element of an article to be held.

10. The article holder of claim 9, wherein retaining through slot includes a pair of opposing resilient ribs to enhance the holding capacity of said resilient retaining loop.

11. The article holder of claim 1, wherein said resilient retaining loop forms a retaining through slot suitable for receiving an elongate element of an article to be held.

12. The article holder of claim 11, wherein said retaining through slot includes a pair of opposing resilient ribs to enhance the holding capacity of said resilient retaining loop.

13. The article holder of claim 1, wherein said outer clasp member is resilient.

14. The article holder of claim 13, wherein said outer clasp member is fabricated from silicone, synthetic rubber, or plastic.

15. An article holder, comprising:

a base having a top side and a planar bottom side having a ferromagnetic portion;

a plurality of fabric engaging elements extending from said bottom side and defining a gripping area;

an inner clash member having at least one magnet having a circumference that fits within said gripping area; and a resilient retaining loop disposed on said top side, said resilient loop having an article engaging through slot configured to accept and releasably capture an elongate element of an article.

16. The article holder of claim 15, wherein said fabric engaging elements comprise staple points disposed about at least one staple plate, and wherein said base is configured with at least one recess to secure said at least one staple plate.

17. The article holder of claim 16, wherein said base includes at least two staples separated by a medial portion of said base, and wherein said resilient retaining loop is disposed on said medial portion.

18. The article holder of claim 17, wherein said base and said resilient retaining loop are integrally formed.

19. The article holder of claim 15, wherein said resilient retaining loop includes resilient ribs.

* * * * *